US011557160B2

(12) United States Patent
Zeus et al.

(10) Patent No.: US 11,557,160 B2
(45) Date of Patent: Jan. 17, 2023

(54) ACTUATION HANDLE WITH ACCESS CONTROL SYSTEM

(71) Applicant: HOPPE AG, Lana (IT)

(72) Inventors: Christian Josef Stephan Zeus, Stilfs (IT); Oliver Erich Rudolf Schuberth, Laas (IT); Kilian Günther Englert, Schonungen (DE); Simon Pedross, Graun im Vinschgau (IT)

(73) Assignee: HOPPE AG, Lana (IT)

( * ) Notice: Subject to any disclaimer, the term of this patent is extended or adjusted under 35 U.S.C. 154(b) by 0 days.

(21) Appl. No.: 17/279,529

(22) PCT Filed: Sep. 24, 2019

(86) PCT No.: PCT/EP2019/075760
§ 371 (c)(1),
(2) Date: Jun. 9, 2021

(87) PCT Pub. No.: WO2020/064769
PCT Pub. Date: Apr. 2, 2020

(65) Prior Publication Data

US 2021/0312732 A1 Oct. 7, 2021

(30) Foreign Application Priority Data

Sep. 24, 2018 (EP) ..... 18196389

(51) Int. Cl.
*G07C 9/00* (2020.01)

(52) U.S. Cl.
CPC ..... *G07C 9/00309* (2013.01); *G07C 2009/00373* (2013.01); *G07C 2209/64* (2013.01); *G07C 2209/65* (2013.01)

(58) Field of Classification Search
None
See application file for complete search history.

(56) References Cited

U.S. PATENT DOCUMENTS 6,552,649 B1 * 4/2003 Okada ..... G07C 9/00309 340/10.33
7,071,812 B2 * 7/2006 Mafune ..... B60R 25/246 340/5.2

(Continued)

FOREIGN PATENT DOCUMENTS

DE 102005055225 A1 5/2007
DE 102014113832 A1 3/2016

(Continued)

OTHER PUBLICATIONS

Anonymous; Modular design; Wikipedia (last visited Jun. 22, 2021); Aug. 10, 2018; URL:https://en.wikipedia.org/w/index.php?title-Modular_design&oldid=854264370.

*Primary Examiner* — Carlos Garcia
(74) *Attorney, Agent, or Firm* — Reinhart Boerner Van Deuren P.C.

(57) ABSTRACT

An actuation handle (4) for attaching to an outside of a door (2) has an access control system designed to control a motorized lock, that contains an evaluation unit and a reader (8) for reading and identifying a transponder located in a first detection range (12) defined by the reader (8). The reader (8) is integrated in the actuation handle (4). There is also a sensor (10) for detecting an object located in a second detection range (14) defined by the sensor (10), which is coupled to the evaluation unit and integrated in the actuation handle (4). The sensor (10) is located on a first section (16) of the actuation handle (4), and the second detection range (14) extends outward from the first section (16). The evaluation unit is configured to activate the sensor (10) to detect an object in the second detection range (14) after identifying a transponder.

22 Claims, 6 Drawing Sheets

(56) References Cited

U.S. PATENT DOCUMENTS

Figure 1A:
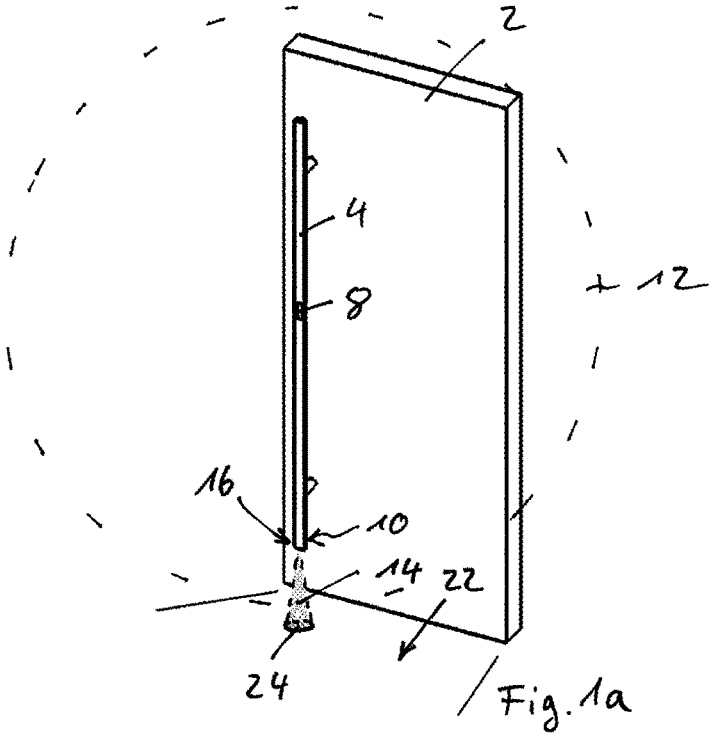

| | | | | |
|---|---|---|---|---|
| 7,102,487 | B2 * | 9/2006 | Mafune | G07C 9/00309 340/552 |
| 7,190,817 | B1 * | 3/2007 | Schneider | G06V 40/12 382/126 |
| 7,283,034 | B2 * | 10/2007 | Nakamura | E05B 81/78 340/5.2 |
| 9,406,179 | B2 * | 8/2016 | Ayeva | G07C 9/00309 |
| 9,721,403 | B2 * | 8/2017 | Müller | E05B 81/04 |
| 9,744,627 | B1 * | 8/2017 | Thrasher | E05B 79/06 |
| 10,171,978 | B2 * | 1/2019 | Padgett | H01Q 1/36 |
| 2007/0126246 | A1 * | 6/2007 | Suzuki | G07C 9/00309 292/336.3 |
| 2007/0241264 | A1 * | 10/2007 | Sata | G06F 3/044 250/221 |
| 2013/0241694 | A1 | 9/2013 | Sharma et al. | |
| 2016/0343189 | A1 | 11/2016 | Dumas et al. | |
| 2019/0096153 | A1 * | 3/2019 | Cho | G07C 9/00896 |

FOREIGN PATENT DOCUMENTS

| | | | |
|---|---|---|---|
| EP | 1244068 | A2 | 9/2002 |
| WO | WO 2007/144766 | A2 | 12/2007 |

* cited by examiner

ACTUATION HANDLE WITH ACCESS CONTROL SYSTEM

The invention relates to an actuation handle, e.g. a door or window handle, according to the preamble of claim 1.

Doors and windows normally have a closing mechanism for closing doors or windows in buildings to prevent access from outside, or to close the buildings against weather. The closing mechanism can be actuated from the inside with an actuation handle when the closing mechanism is not locked. Moving handles directly coupled to the closing mechanism are frequently not mounted on the outsides of doors or windows. Door plates with rigid handles or knobs require that the closing mechanism be unlocked exclusively by means of a key inserted into a lock.

Electromechanical door locks are unlocked by a motor after a key (mechanical or digital) has been identified. For this, a key card or transponder must be held in front of a reader. This requires two manipulations.

The object of proposing an actuation handle, in particular in the form of a door or window handle, is derived therefrom, with which the manipulation effort for unlocking a door lock is simplified by a transponder.

The main features of the invention are given in the characterizing part of claim 1. Embodiments are the subject matter of claims 2 to 15.

An actuation handle for attachment to the outside of a door is proposed, which has an access control system for actuating a motorized lock with an evaluation unit and a reader for reading and identifying a transponder placed in a first detection range defined by the reader. The reader is integrated in the actuation handle. Furthermore, a sensor for detecting an object located in a second detection range defined by the sensor is coupled to the evaluation unit and integrated in the actuation handle. The sensor is located on a first section and the second detection range extends outward from the first section. The evaluation unit is also configured to activate the sensor to detect an object in the second detection range after identifying a transponder.

The actuation handle is understood to be a mechanism used to open and close a door or window. The invention does not require an element moved by the user. The actuation handles can therefore also relate to a rigid, non-moving door or window handle.

The access control system is used to read and identify a transponder in the proximity of the reader via the reader. This means that it is checked whether the transponder is a transponder previously identified by the system. If such a transponder is identified, the door in question can be opened. The actuation handle according to the invention integrates such an access control system in a particularly advantageous manner.

The evaluation unit can be an electronic device that can be configured to receive data from a transponder and process this data for purposes of access control. It is coupled to the reader such that it can receive these data. The location where the evaluation unit is installed and the design thereof are insignificant for the design of the actuation handle according to the invention.

It is more important that the evaluation unit is coupled to the reader and the sensor. The evaluation unit can also be integrated in the reader or the sensor, and fulfill its intended functions there.

The reader is a device capable of reading a transponder in a first detection range. There are various radio signal-based technologies for this. The reader has one or more antennas for this, and a radio circuit connected thereto. The reader can emit s continuous or cyclical radio signal with a very limited range. The range forms the first detection range surrounding the installation location of the reader. If there is a transponder in the first detection range, i.e. the radio signal range of the reader, it can react to the emitted radio signal. The transponders can also be passive, such that a circuit located therein cab be supplied with electricity by the radio signal, and send a desired data set back to the reader. In this case, the first detection range is normally small enough that the transponder practically has to be placed on the reader, or at least very close thereto. Active transponders are also conceivable, which transmit an identification upon receiving a radio signal, or respond to a radio signal after an input means has been actuated, e.g. a button. The type and design of the reader and transponder are irrelevant to the design of the actuation handle. It may be useful to coordinate the reader and transponder such that a range of numerous decimeters to somewhat more than one meter can be obtained. This allows a user to simply carry a transponder when approaching the actuation handle.

In addition to the reader, the sensor is placed on the actuation handle such that a second detection range is formed that extends outward from the actuation handle. The function of the sensor differs significantly from that of the reader, and can identify an object in the second detection range. The second detection range preferably differs from the first detection range, in particular with regard to the spatial orientation in relation to the actuation handle.

The sensor and the second detection range allow the actuation handle to detect a gesture by a foot or a hand as a control command. If a transponder is read and identified in the first detection range, and if an object or gesture is detected in the second detection range, a door opening signal can be generated. In order to execute this procedure, the evaluation unit is configured to activate the sensor to detect an object in the second detection range after identifying a transponder.

The handle according to the invention consequently forms an extremely convenient possibility for opening a door, or initiating the opening, because it is not necessary to move a door or window handle. A gesture can be easily made by a foot. The first detection range can also be selected such that a user carries the transponder, e.g. in a pocket, and when approaching the actuation handle, initiates the opening of the door simply with a gesture or the like.

In a preferred embodiment, the reader is located in a first housing, and forms a first assembly. The reader can contain numerous individual components, e.g. a control unit, one or more antennas, signal electronics, etc. The reader can be an electronic module on a printed circuit board, for example, that can be connected to external components via electrical lines. The reader can be located in the first housing and encapsulated, in order to protect the individual components, simplify assembly, and increase the reliability. The reader then forms a single component that can be integrated on or in the actuation handle.

The reader is preferably cast in a resin in the first housing. This ensures that it is particularly robust with regard to external physical effects, and has a long service life.

In a preferred embodiment, the reader fits into a hollow chamber in the actuation handle. The reader, or the first housing, is therefore sized such that is can be entirely inserted into the hollow chamber. The fit can be obtained by selecting a cross section that is slightly smaller than the cross section of the hollow chamber. By integrating it in the actuation handle, the outer appearance of the actuation handle remains undisturbed, and the reader is mechanically protected.

In one advantageous embodiment, at least part of the actuation handle forms a rod with opposing first and second ends, wherein the first section is located at the first end. The actuation handle basically forms a rod handle or a lever handle extending more or less over the length of the door. These actuation handles are frequently vertical, such that the first end can be a lower end of such a rod handle, while the second end extends vertically upward. The first section can be located on the first end such that the first section and the first end are the same. If the actuation handle is to be vertical, the sensor can point downward. The second detection range can consequently extend to the floor in front of the door. If the actuation handle is horizontal, the second detection range can also extend at a right angle thereto, toward the floor.

Other variations are also possible, in which the second detection range and the orientation of the actuation handle can be selected or set independently of one another.

The actuation handle preferably has a main axis of extension, and the second detection range is parallel to this main axis of extension. The sensor is consequently located on preferably an end of the actuation handle, and is oriented such that the axis of the sensor is substantially parallel to the main axis of extension thereof. Object that is to be detected must therefore pass through an extension of the main axis of extension of the actuation handle, at a distance to the relevant end.

The sensor can extend in part from the actuation handle. The actuation handle can have a recess or opening in the first end for this, in which the sensor is located. The detection behavior of the sensor can then be dictated exclusively by its structure, and is not limited by a potential installation situation. As a result of this extension, it can also be easily cleaned or serviced.

In one advantageous embodiment, the sensor can form an ultrasonic sensor. These sensors emit soundwaves in the ultrasonic range that are reflected on objects located in the second detection range. The distance to the object reflecting the soundwaves can be determined by determining a travel time for the reflected soundwaves. In certain installation situations, a floor or wall surface can always be located in the second detection range, which always reflects the soundwaves when the sensor is activated. The sensor, evaluation unit, or other superordinate components can be configured by adapting a circuit or programming such that this reflection is not interpreted as the object to be detected. If another object moves within the second detection range, which is therefore located between the sensor and the respective wall or floor surface, the travel times are then shorter. This temporary decrease in the travel time should then be interpreted as the object that is to be detected.

Other variations can also be used instead of an ultrasonic sensor. These can comprise a camera, infrared sensor, optical flow sensor, laser scanner, etc.

The actuation handle can also contain a lamp that emits light toward the second detection range during the detection procedure. This results in the possibility of indicating to a user that a gesture or the like is expected in the second detection range. This can then be initiated when a known transponder is identified and the sensor is activated.

The lamp is preferably coupled to the sensor. The lamp consequently only emits light when the sensor is activated and a corresponding input is expected.

In a particularly advantageous embodiment, the light emitted by the lamp is focused by a lens to a light spot. A light spot can be generated by focusing the light, which is projected onto a floor or wall surface. A user's attention can be drawn to the wall or floor surface by the light spot. The lens can be tinted or transparent. It is useful to generate a light spot with a diameter of up to 20 cm on the relevant surface that can be easily identified. The light spot can preferably have a diameter of up to 12 cm. The lamp can also be configured such that the light spot is visible in daylight. It is also advantageous to make the shape of the light spot sharply focused in relation to the background.

The lamp is particularly preferably configured to emit a cone of light. The second detection range preferably encompasses the entire light cone.

The sensor and the lamp are preferably located in a second housing and form a second assembly. Because the functions of the sensor and the lamp are preferably coupled to one another, it makes sense to integrate these functions in a single assembly. The lamp can then be coupled directly to the sensor. The second detection range and a cone of light emitted by the lamp can then be easily adjusted to one another. The second assembly can be fully encapsulated before it is integrated in the relevant actuation handle. This simplifies assembly and reduces the steps necessary for establishing electrical contact to the light.

The second housing is also fit into a hollow chamber in the actuation handle in an advantageous embodiment. Depending on its design, the rod handle or the like does not have to be solid, and instead can be hollow. Because the sensor and lamp are intended to be integrated in the actuation handle, it may be useful to place these components directly inside the hollow chamber. With an appropriate design of the second housing, it, or the second assembly, can be slid entirely into the hollow chamber in the actuation handle in order to secure it therein.

The second housing preferably has a groove for a sealing ring. The groove is preferably circumferential, and a corresponding sealing ring fits therein. Depending on the design of the actuation handle, the grooves and sealing rings may be of different shapes.

The second housing can have a projection window. This can be located in front of the lens or lamp, and allow light to pass through. The projection window can have a specific shape, which then affects the shape of the light spot in the desired manner.

The sensor can also contain a sensor circuit that is configured to recognize a predefined movement from the sensor signals supplied by the sensor, and to output a confirmation signal to the evaluation unit when a movement has been recognized. Depending on the design of the sensor, more or less complex movements can be recognized. If the sensor is an ultrasonic sensor, which can only determine a distance to an object, an entering of an object in the second detection range can be detected for a limited time. This means that the sensor first detects no object in a detection period, and then detects an object for a certain period of time, after which the object is no longer detected. This can correspond to passing a hand or foot through the second detection range. The sensor circuit is configured to emit a corresponding signal when such a movement has been identified. It is not necessary to send all of the unprocessed measurement data to the evaluation unit.

In an advantageous embodiment, the reader and/or sensor are/is secured in a hollow chamber in the actuation handle through clamping or screwing. With clamping, no dedicated attachment devices are needed, and the cross section of the actuation handle can be selected within a wide range, without requiring readers and/or sensors of different designs. Preferably a housing encompassing the reader or sensor can be clamped in place. In a particularly advantageous case, the relevant housing can have at least one threaded hole, into which a screw can be screwed. By turning the screw such that it is unscrewed from the threaded hole, the size of the housing and screw assembly can be increased. If the housing and the screw are inside the actuation handle, this clamps the housing securely therein. The screw can be turned through a hole that cannot be seen by a user when the handle is installed on the door. Such a clamping embodiment also has the advantage of an easy assembly and removal. A step or stop can also be formed in the actuation handle, beyond which the relevant housing cannot be pushed into the hollow chamber. The alignment of the screw and the hole can thus be simplified. Alternatively, it is also possible to screw the housing in place with a single screw that extends through a hole into the relevant components. The use of a countersunk screw that is flush with the outer surface of the actuation handle would also be advantageous.

For a tactile feedback when clamping, the first housing can have tongues on the edge or lateral surfaces, which extend outward from the first housing, and are slid into grooves when clamping the first housing in place. A noticeable pre-tension is then obtained when tightening the screw. If a tongue passes fully though a groove, the force needed to turn the screw immediately becomes greater, indicating that the housing is securely clamped in place. The tongues can also generate a certain retaining force, which counteracts a displacement of the hole in relation to the screw when installing the reader in the actuation handle.

In an advantageous embodiment, the actuation handle consequently has holes through which tools can be inserted into the hollow chamber in order to tighten or loosen screws for clamping or releasing the reader and/or sensor.

The reader preferably has an active surface lying in a recess in the actuation handle, and which is flush with an outer surface of the actuation handle. The range, and therefore the first detection range, can then be precisely set and implemented without interferences.

Figure 1C:
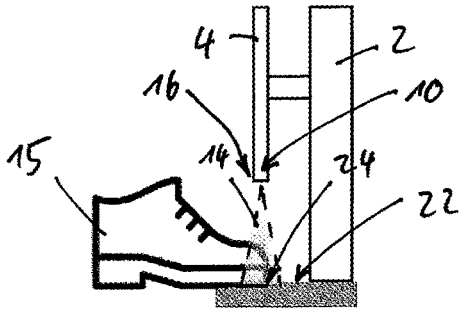
Figure 1B:
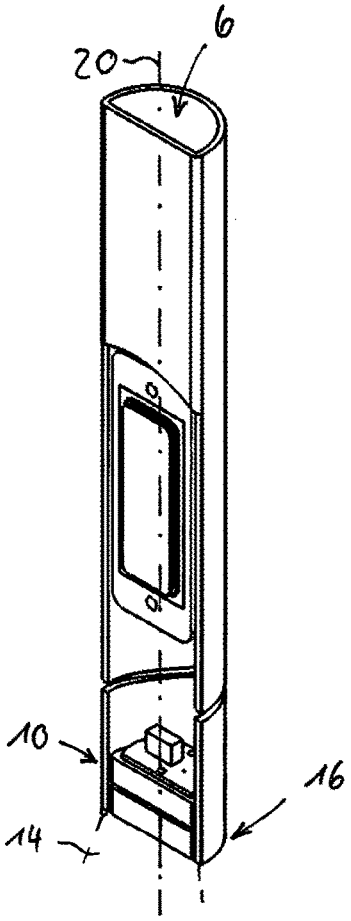
Figure 2:
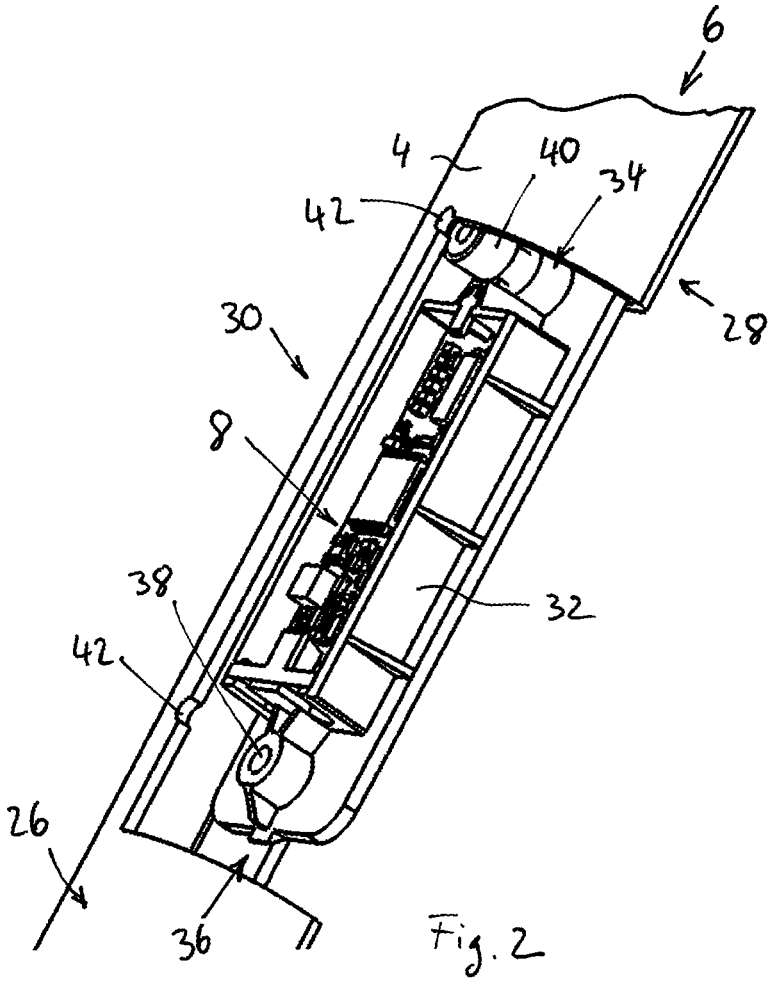
Figure 3A:
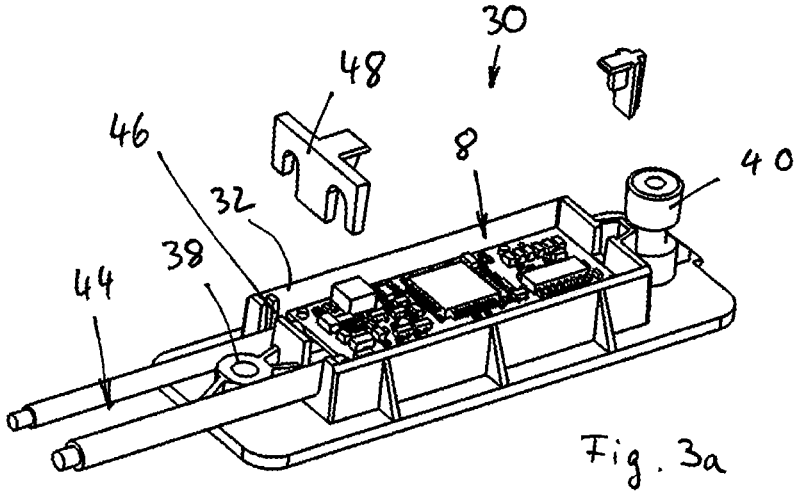
Figure 3B:
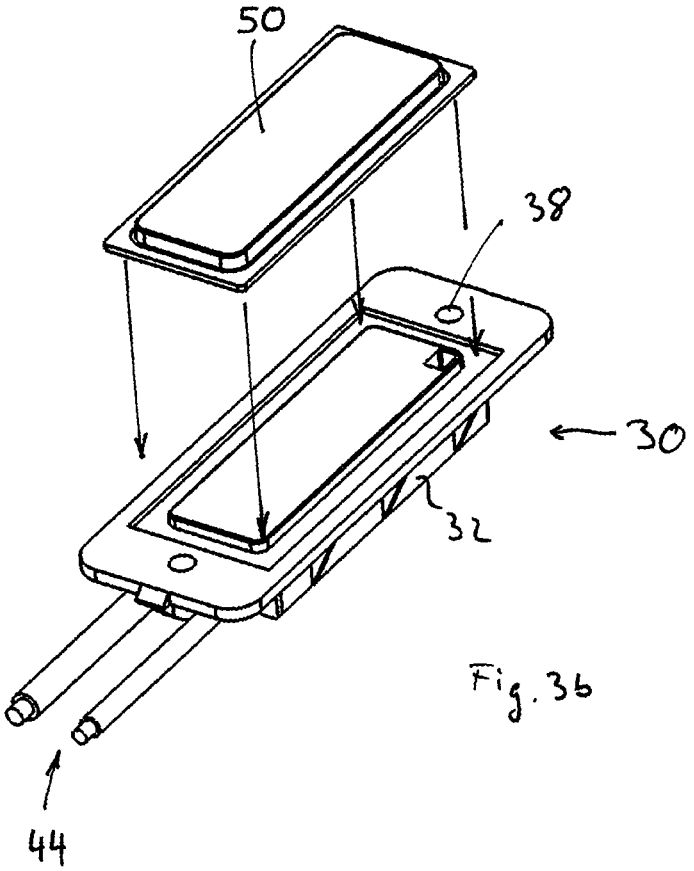
Figure 4A:
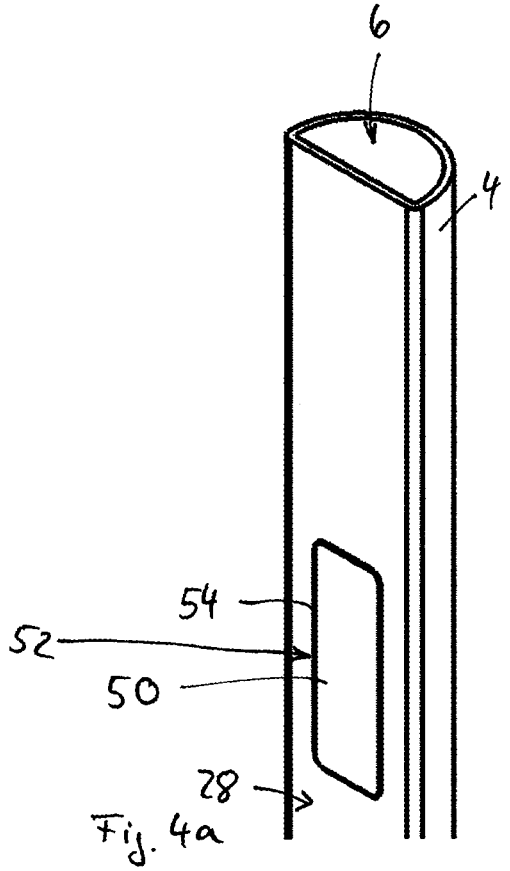
Figure 4B:
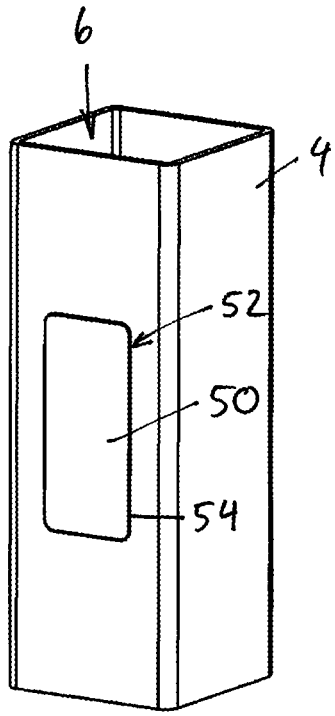
Figure 4C:
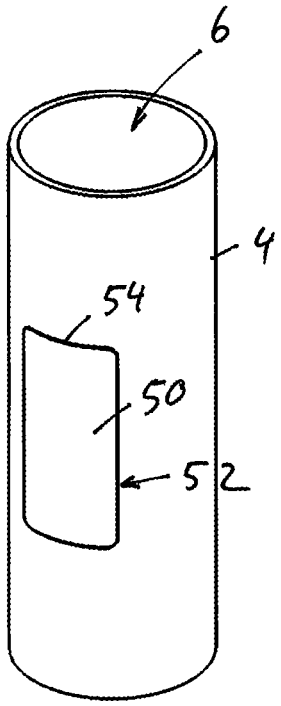
Figure 5A:
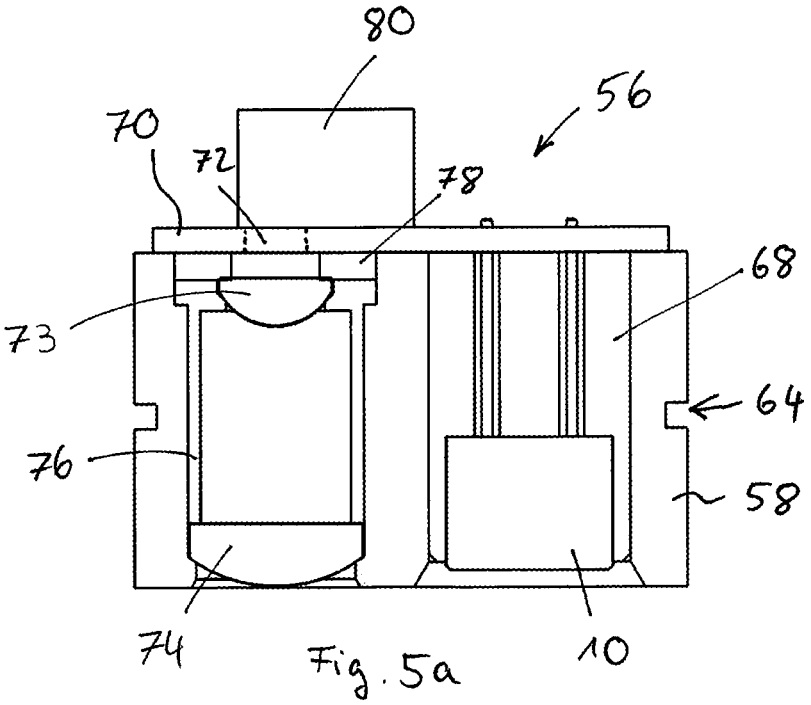
Figure 5B:
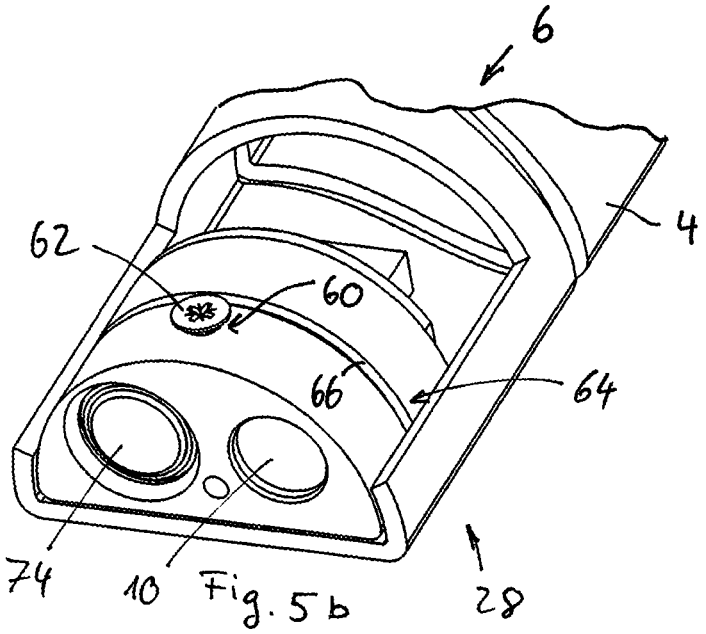
Figure 6A:
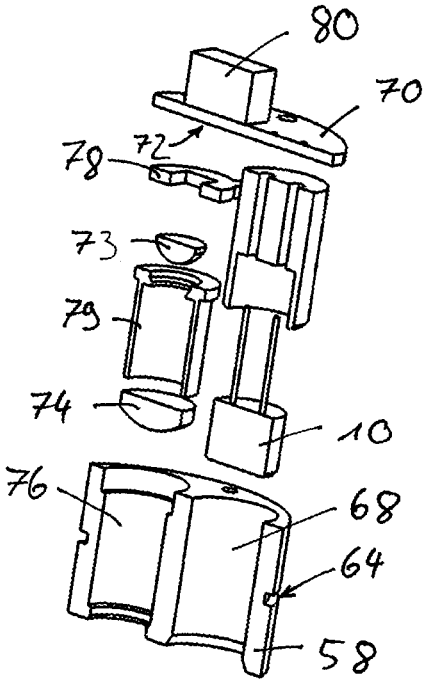
Figure 6B:
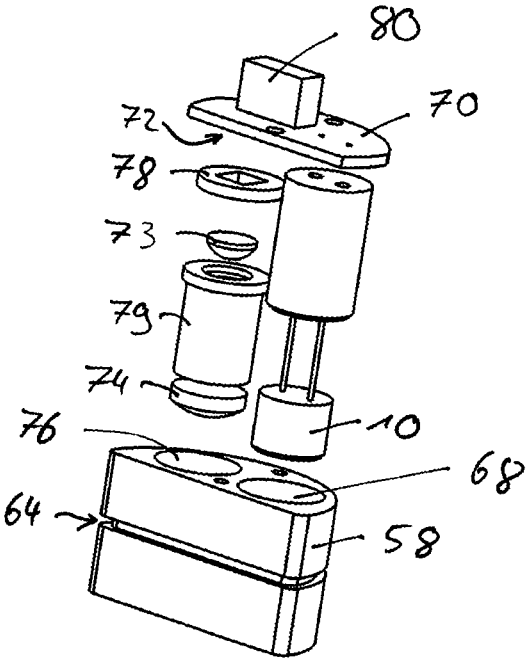
Figure 7A:
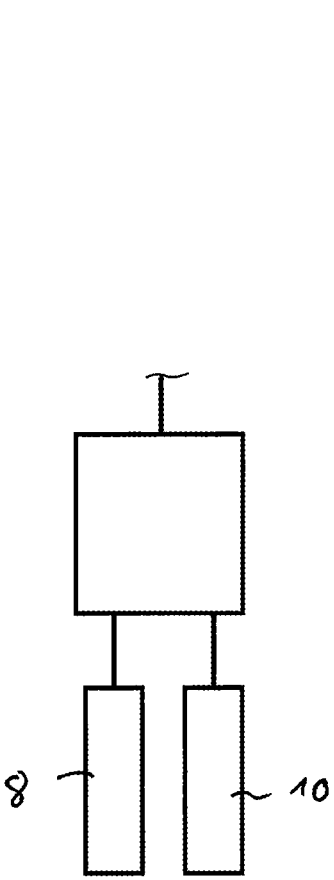
Figure 7B:
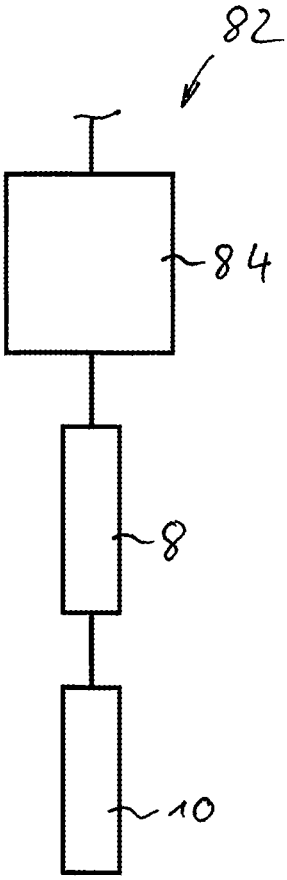
Figure 7C:
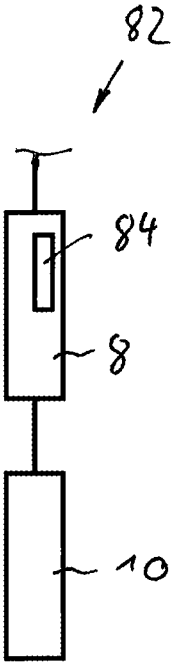

Further features, details and advantages of the invention can be derived from the wording of the claims and the following description of exemplary embodiments, based on the drawings. Therein:

FIGS. 1*a*, 1*b* and 1*c* show an actuation handle on a door;

FIG. 2 shows a partially transparent section of an actuation handle with a reader integrated therein;

FIGS. 3*a* and 3*b* show a reader with a housing and electrical lines in two different views;

FIGS. 4*a* to 4*c* show different cross section variations for the actuation handle in illustrations that show an active surface on the reader;

FIGS. 5*a* and 5*b* show a section of the actuation handle with a sensor installed therein;

FIGS. 6*a* and 6*b* show an exploded view of a second assembly containing a sensor and a light; and FIGS. 7*a* to 7*c* show a schematic illustration of an access control system with a reader and a sensor integrated in the actuation handle.

FIG. 1*a* shows an outside of a door 2, e.g. in the form of house door. An actuation handle 4 is located thereon in the form of a rod-shaped handle, which is perpendicular on the door 2. The actuation handle 4 has a hollow chamber 6 indicated in FIG. 1*b*, in which a reader 8 and a sensor 10 are located.

The reader 8 and the sensor 10 are components of an access control system. This is configured to initiate the opening of a motorized lock by reading and identifying transponders and subsequently detecting an object with the sensor 10. The reader 8 has a first detection range 12, in which a transponder carried by a user can be read. The sensor 10 has a second detection range 14, in which the presence of an object can be detected after identifying a transponder authorized for the opening. The sensor 10 can be broadly understood to be an input means, which can be triggered by a gesture with a foot or hand, and actually activates the opening of a motorized lock.

In this illustration of the actuation handle 4, the second detection range can extend outward from a first end 16 forming the first section of the actuation handle 4. The second detection range is concentrated, by way of example, on a basically cylindrical, conical, or club-shaped region extending outward from the sensor 10. As a result of the orientation of the sensor 10, a direction of extension 18 for the second detection range 14 is generated, which is substantially aligned with a main axis of extension 20 of the actuation handle 4. In this illustration, the second detection range 14 consequently reaches from a lower end of the actuation handle 4 to a floor 22 in front of the door 2. If an object enters this detection range 14, shown by way of example as a foot, or shoe in the enlargement shown in FIG. 1*c*, this object can be recognized by the sensor 10.

To indicate the second detection range 14 and the activation of the sensor 10 in an intuitive manner to a user, there is a lamp (not shown herein) that projects a light spot 24 onto the floor 22. The configuration of the aforementioned components shall be explained in greater detail in reference to the other figures.

FIG. 2 shows a recess in the actuation handle 4, in which a reader 8 is integrated. By way of example, the actuation handle 4 has a cross section that is curved on one side but flat on the other side. The curved side can face the door 2 in the installed state, such that the flat side 28 then faces away from the door 2. As a matter of course, the actuation handle 4 could also have another cross section.

It can be seen in this illustration that the reader 8 forms a closed unit, referred to below as the first assembly 30, which is integrated in the actuation handle 4. The first assembly 30 has a first housing 32, which encompasses the reader 8. There are threaded holes 38 on two ends 34 and 36, into which screws are threaded. The actuation handle 4 also has through holes 42 on its curved side 26, each of which are aligned with the threaded holes 38, through which a user can insert a tool for turning the screws 40. If the screws 40 are screwed outward from the respective threaded holes 38, they come in contact with an inner surface of the actuation handle 4, thus clamping the first housing 32 in the hollow chamber 6. This ensures not only a reliable securing of the reader, but also provides a simple means for disassembly.

FIG. 3*a* shows an enlargement of the first assembly 30. It can be seen therein that the first housing 32 is significantly larger than is needed to actually accommodate the reader 8. Electrical connecting lines 44 are shown, which extend outward from the interior of the housing 32. By way of example, there are notches 46 in which the connecting lines 44 can be placed, as well as a clamp 48 that can be inserted into the first housing 32 to secure the connecting lines 44 on the first housing 32. The first housing 32 is filled with a casting resin in order to seal the reader 8 and encapsulate the entire first assembly 30. As a result, the reader is irreversibly, fully encompassed in a watertight sheath, and is reliably protected from mechanical effects. When encapsulating the first housing 32, the clamps 48 seal the first housing 32. The first housing 32 can substantially form a basin, one side of which is open, and all other sides of which are closed.

The reader 8 can have a dedicated active surface 50, shown on a lid in FIG. 3*b*, which should not be covered when integrated in the actuation handle, in order to maintain a sufficient range. The active surface 50, which can be referred to as the viewing surface, extends from the first housing 32. It is advantageous if the active surface 50 lies in a corresponding recess in the actuation handle 4.

FIG. 4*a* shows a subsection of the actuation handle 4 in a three dimensional illustration. A recess 52 can be seen therein, that passes through the actuation handle 4 on its flat side 28. The active surface 50 of the reader 8 can be inserted backwards therein. It should be noted here that the active surface 50 is preferably located on the first assembly 30 such that the flat side 28 and the active surface 50 are flush to one another. This results in a harmonious surface design, that does not disrupt the visual appearance of the actuation handle 4.

An additional sealing ring 54 can also be placed between the active surface 50 and the recess 52. The visible part of the sealing ring 54 at the recess 52 can be narrower than in the hollow chamber 6, such that it presses against the recess 52 from the inside when the first assembly 30 is clamped securely in place, but cannot pass through, due to the design, such that the sealing ring 54 appears to be flush therewith.

As explained above, the actuation handle 4 can take different forms, which are shown in FIGS. 4*b* and 4*c*. FIG. 4*b* shows an actuation handle 4 with a substantially rectangular cross section. FIG. 4*c* shows a classic, entirely cylindrical cross section, as is often used with rod handles. Although the active surface 50 in the variations shown in FIGS. 4*a* and 4*b* can have the same design, the active surface 50 is curved in the variation shown in FIG. 4*c*.

FIGS. 5*a* and 5*b* show a second assembly 56 that is to be positioned on the first end 16 of the actuation handle 4 and contains the sensor 10 located therein. There is a second housing 58 for this, which fits into the hollow chamber 6 in the actuation handle 4. It can therefore be inserted through an opening in the first end 16 of the actuation handle 4. There is also a threaded hole 60 here for securing it, in which a screw 62 is located. This is preferably a counter-sunk screw. As a result, the second housing, and consequently the second assembly 56, can also be secured in the hollow chamber 6 in the actuation handle 4.

To seal the transition between the inner wall of the actuation handle 4 and the second assembly 56, the second housing 58 has a circumferential groove 64 in which an appropriately shaped sealing ring is placed. It should be noted that the groove 64 and the sealing ring are designed such that the sealing ring is securely retained by the groove 64, such that it is not removed or sheared when the second assembly 56 is inserted into the hollow chamber 6. A sealing ring 66 is shown in FIG. 5*b* that is retained entirely in the groove 64, and bears on the inner surface of the hollow chamber 6.

Additionally, the second assembly 56 is shown in an exploded view with the separate second housing 58 in FIGS. 6*a* and 6*b*. The second housing 58 has a first receiving space 68 for the sensor 10. This sensor is located by way of example on a printed circuit board 70, which also contains a sensor evaluation circuit. A lamp 72 is also indicated by a broken line, which is likewise on the printed circuit board 70, next to the sensor 10. This lamp 72 can be coupled electrically to the sensor 10 or the printed circuit board 70, such that when the sensor 10 is active, the lamp 72 is also on, and emits light.

There is a lens 74 for focusing the light, which can be placed in a second receiving space 76. This space is next to the first receiving space 68 in the second housing 58. When the sensor 10 and lens 74 are placed in the corresponding receiving spaces 68 and 72, the printed circuit board 70 is flush with the second housing 58. The lamp 72 can be a light emitting diode soldered to the printed circuit board 70, which has a first lens 73. By way of example, this can be placed in a mount 78 on the printed circuit board 70. The lens 74, mount 78, and first lens 72 can be preassembled in a lens tube 79.

By way of example, an electrical connector 80 is placed on the printed circuit board 70 on a side facing away from the sensor 10 and the lamp 72. The connector 80 can be coupled to a superordinate system. The printed circuit board 70 can also contain a sensor evaluation circuit that controls the sensor 10 and the lamp 72, and evaluates signals or data provided, in particular, by the sensor 10. The sensor evaluation circuit is preferably configured to detect an object in the second detection range from the raw signals. A signal can then be provided via the electrical connector 80, indicating that a corresponding object has been detected. As a result, it is not necessary to send all of the signals form the sensor 10 to a superordinate unit for processing.

FIGS. 7*a*, 7*b*, and 7*c* also show a highly simplified construction of an access control system, formed by the reader 8, sensor 10, and an evaluation unit 84. The evaluation unit 84 is connected to the reader 8, or forms a part thereof. It can compare the input data from a transponder, for example, with data from a stored data set from transponders authorized for access, and determine whether the transponder in the first detection range is a transponder authorized for access.

If a transponder authorized for access is identified, the evaluation unit 84 can activate the sensor 10 for detecting an object in the second detection range. It can then send a signal indicating this detection to the evaluation unit 84, or it can transmit raw data or raw signals for evaluation in the evaluation unit 84.

The sensor 10 and the evaluation unit 84 can be connected directly to one another, or via a serial connection through the reader 8. A wired connection is conceivable. Alternatively, a wireless connection is also conceivable. If a wireless connection is to be used, the evaluation unit 84 and the sensor must be equipped with corresponding connection devices, e.g. transmitters and receivers.

The sensor 10 can be powered by a long-life battery or via electrical lines.

The reader 8 can also be connected directly or indirectly to the evaluation unit 84. The reader is then preferably supplied with power via electrical lines. In the case of a wireless connection, corresponding connection devices, e.g. transmitters and receivers, are also necessary.

The invention is not limited to the embodiments described above, and instead can be used in a number of ways.

All of the features, advantages, including constructive details, spatial arrangements and method steps that can be derived from the claims, description, and drawings, may be substantial to the invention in and of themselves or in various combinations thereof.

| List of Reference Symbols | |
|---|---|
| 2 | door |
| 4 | actuation handle |
| 6 | hollow chamber |
| 8 | reader |
| 10 | sensor |
| 12 | first detection range |
| 14 | second detection range |
| 15 | object |
| 16 | first end/first section |
| 18 | direction of extension of the second detection range |
| 20 | main axis of extension |
| 22 | floor |
| 24 | light spot |
| 26 | curved side |
| 28 | flat side |
| 30 | first assembly |
| 32 | first housing |
| 34 | end of the first housing |
| 36 | end of the first housing |
| 37 | tongue |
| 38 | threaded hole |
| 40 | screw |
| 42 | through hole |
| 44 | electrical connection line |
| 46 | notch |
| 48 | clamp |
| 50 | active surface |
| 52 | recess |
| 54 | sealing ring |
| 56 | second assembly |
| 58 | second housing |
| 60 | threaded hole |
| 62 | set screw |
| 64 | groove |
| 66 | sealing ring |
| 68 | first receiving space |
| 70 | printed circuit board |
| 72 | light |
| 73 | first lens |
| 74 | lens |
| 76 | second receiving space |
| 78 | mount |
| 79 | lens tube |
| 80 | electrical connector |
| 82 | access control system |
| 84 | evaluation unit |

The invention claimed is:

1. An actuation handle (4) for attaching to an outside of a door (2), comprising an access control system (82) designed to control a motorized lock, that has an evaluation unit (84) and a reader (8) for reading and identifying a transponder located in a first detection range (12) defined by the reader (8), characterized in that the reader (8) is integrated in the actuation handle (4), and a sensor (10) for detecting a non-contact gesture by an object (15) located in a second detection range (14) defined by the sensor (10) is coupled to the evaluation unit (84) and integrated in the actuation handle (4), wherein the sensor (10) is located on a first section (16) of the actuation handle (4), and the second detection range (14) extends outward from the first section (16), wherein the evaluation unit (84) is configured to activate the sensor (10) to detect the non-contact gesture by the object (15) in the second detection range (14) after the transponder has been identified.

2. The actuation handle (4) according to claim 1, characterized in that the reader (8) is located in a first housing (32) and forms a first assembly (30).

3. The actuation handle (4) according to claim 1, characterized in that the reader (8) is cast in a resin in the first housing.

4. The actuation handle (4) according to claim 1, characterized in that the actuation handle (4) is rod-shaped, at least in sections, and has a first end (16) and a second opposing end, wherein the first section (16) is on the first end (16).

5. The actuation handle (4) according to claim 1, characterized in that the actuation handle (4) has a main axis of extension (20), and the second detection range (14) is parallel to the main axis of extension (20).

6. The actuation handle (4) according to claim 1, characterized in that the sensor (10) extends at least in part out of the actuation handle (4).

7. The actuation handle (4) according to claim 1, characterized in that the sensor (10) is an ultrasonic sensor.

8. The actuation handle (4) according to claim 1, characterized by a light (72) that emits light in the second detection range (14) during the detection procedure.

9. The actuation handle (4) according to claim 8, characterized in that the light (72) is coupled to the sensor (10).

10. The actuation handle (4) according to claim 8, characterized in that a lens (74) focuses the light emitted by the light (72) to form a light spot (24).

11. The actuation handle (4) according to claim 8, characterized in that the sensor (10) and the light (72) are located in a second housing (58) and form a second assembly (56).

12. The actuation handle (4) according to claim 11, characterized in that the second housing (58) fits in an interior space in the actuation handle (4).

13. The actuation handle (4) according to claim 1, characterized in that the reader (8) and/or the sensor (10) are/is secured in a hollow chamber (6) in the actuation handle (4) by clamping or screwing.

14. The actuation handle (4) according to claim 13, characterized in that the actuation handle (4) has through holes (42) through which a tool can be inserted into the hollow chamber (6) to drive screws (40, 62) to clamp or release the reader (8) and/or sensor (10).

15. The actuation handle (4) according to claim 1, characterized in that the reader (8) has an active surface (50), which lies in cut-out (52) in the actuation handle (4) and is flush with an outer surface of the actuation handle (4).

16. The actuation handle of claim 1, wherein the non-contact gesture is the object entering the second detection range.

17. The actuation handle of claim 16, wherein:

the sensor is located at an end of the actuation handle;

the actuation handle (4) has a main axis of extension (20); and the second detection range (14) is parallel to the main axis of extension (20).

18. The actuation handle of claim 17, wherein the reader has a first detection range in which the transponder carried by a user can be identified.

19. The actuation handle of claim 18, wherein the evaluation unit generates a motorized lock opening signal when the non-contact gesture is detected by the sensor and wherein the non-contact gesture is independent of the surface characteristics of the object.

20. The actuation handle of claim 19, wherein the actuation handle is configured to be attached to the outside of a door of a building.

21. A door arrangement comprising:

the door for a building, the door having an outside, the door having a top end and a bottom end, the bottom end being positioned between a ground and the top end when mounted to the door; and the actuation handle of claim 17, the actuation handle being mounted to the outside of the door, the second detection range being directed away from the top end of the door and towards the ground.

22. The door arrangement of claim 21, wherein the actuation handle further includes a light (72) that emits light in the second detection range (14) during the detection procedure, the emitted light is directed away from the top end of the door and towards the ground.

* * * * *